US005647138A

United States Patent [19]

Tang et al.

[11] Patent Number: 5,647,138

[45] Date of Patent: Jul. 15, 1997

[54] CAP SHARPENER FOR CLUTCH-TYPE PENCIL

[76] Inventors: Hung Ming Tang, No. 411, Hsin-Wen, Pu Tai Chen, Chia-I Hsien; Plato Chen, 8th Fl., No. 5, Lane 200, Sung-Te Rd., Taipei, both of Taiwan

[21] Appl. No.: 694,302

[22] Filed: Aug. 8, 1996

[51] Int. Cl.[6] ..... B43L 23/08

[52] U.S. Cl. ..... 30/454; 30/457; 30/461

[58] Field of Search ..... 30/451, 453–461

[56] References Cited

U.S. PATENT DOCUMENTS

| | | | |
|---|---|---|---|
| 1,958,461 | 5/1934 | Barclay | 30/457 |
| 3,405,747 | 10/1968 | Dennison | 30/461 |
| 4,406,315 | 9/1983 | Brickhouse | 30/455 X |
| 5,205,664 | 4/1993 | Yushan et al. | 30/454 X |

FOREIGN PATENT DOCUMENTS

| | | | |
|---|---|---|---|
| 126501 | 1/1932 | Australia | 30/460 |

*Primary Examiner*—Douglas D. Watts

*Attorney, Agent, or Firm*—Morton J. Rosenberg; David I. Klein

[57] ABSTRACT

The present invention provides a cap sharpener for clutch-type pencil, in which a blind end divides a cylinder from the cap, and the blind end has a through-hole at the center portion interconnecting the cylinder. The cylinder has a blade mounted on the top inner portion slantly and engaging with a lead which extends through the through-hole of the blind end. Two opposite resilient trips are formed in the inner wall of the cap with two granular projections extending inwardly from the trips, respectively. When turning the cap and a pencil being capped with the cap in an opposite directions, the cap will hold the pencil shaft still for the blade in the cylinder to cut the lead accurately. Additionally, the cylinder can be separated from the cap, and holding the blade in a slanting angle in a hollow body, and connected to the blind end of the cap by means of female and male joining faces. The hollow space of the cylinder, furthermore, can be used for collecting the lead chip powder.

3 Claims, 4 Drawing Sheets

CAP SHARPENER FOR CLUTCH-TYPE PENCIL

BACKGROUND OF THE INVENTION

The present invention relates to a cap sharpener for clutch-type pencil, and more particularly to a pencil lead sharpener that attaches to the top of clutch-type pencil cap for the convenience of sharpening pencils.

In drawing and writing, a conventional clutch-type pencil with a coarse lead refill lead (about 2 mm) has been used by most people. For the convenience of writing, a lead sharpener is designed to be attached to the clutch-type pencil which is a tubular seat having a tapered thimble at one end, and a V-shaped tool bit holder extending from the tip of the tapered thimble for holding a V-shaped metallic blade therein. The other end of the tubular seat has an eraser. In normal state, the sharpener end of the tubular seat sleeves onto the pencil body, while the eraser end exposes to the opposite end. When it is necessary to sharpen the lead, pull the tubular seat away from the pencil body, insert the lead into the tapered thimble and turn the lead clockwise which causes the V-haped blade to shape the lead. This conventional sharpener possesses shortcomings which are as follows:

1. when the lead is inserted into the top of the tapered thimble engaging with the V-shaped blade and turned with the pencil body, the pivot of the lead must be kept in one line, if not the fragile refill lead is easy to be broken up.

2. This lead sharpener has only one opening, the opening of the tapered thimble, wherein the the lead powder cut down is easy to lay up and difficult to clean.

There is another cooperative cap sharpener in the conventional lead sharpeners, which has an ordinary pencil cap at one end, and a cuboid vane seat with a blade at the other end for pencil sharpening. But this conventional cuboid sharpener is used mainly for the traditional pencil and not for the clutch-type pencil.

SUMMARY OF THE INVENTION

A main object of the present invention is to provide a cap sharpener for clutch-type pencil which integrates a sharpener with a pencil cap so that the cap can hold the pencil in a constant pivot as the lead is cut by the sharpener structure, and the chip powder cutting down from the lead can be displaced.

The present invention includes a cap with a through-hole in the center of the top portion of a blind end for extending therethrough a refill lead, a vane set next to the top portion of the through-hole of the blind end on a slant along the axle lead of the hole in the cap, the upper inner portion of the cap holding on a blade and displacing the lead chip powder with an open gate.

DETAILED DESCRIPTION OF PREFERRED EMBODIMENTS

Figure 1:
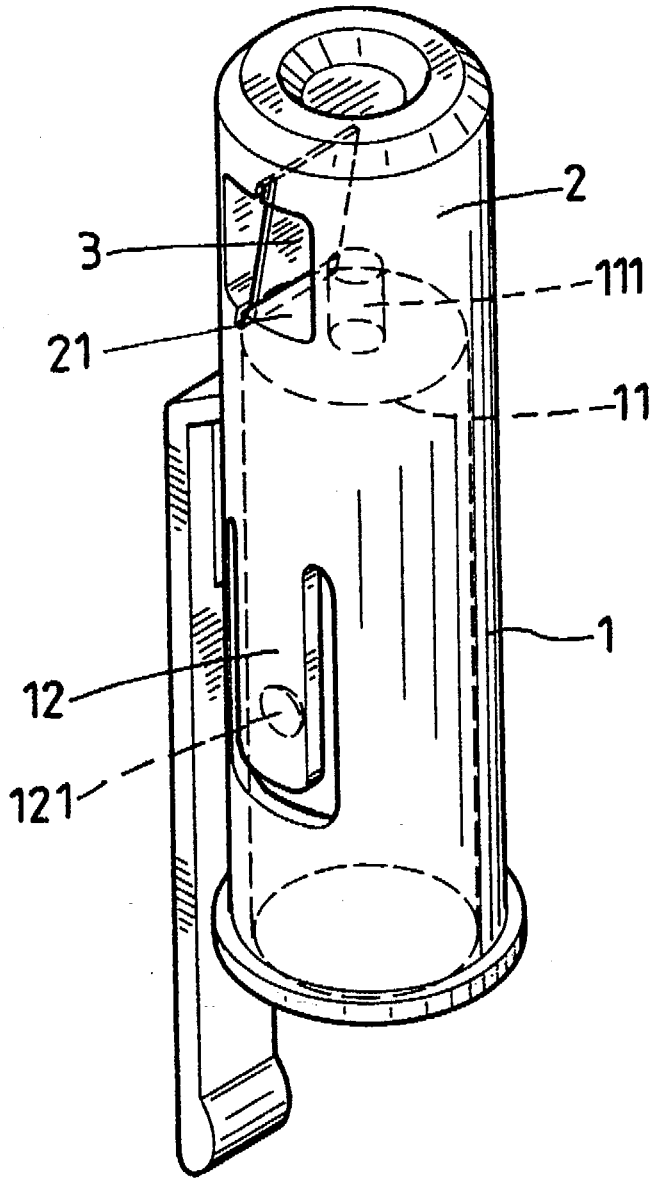
FIG. 1 is a schematic view of the present invention.

Referring to FIG. 1, an operation of the present invention comprises a cap 1, a cylinder 2 at the upper portion thereof, a blade 3 at one side of the cylinder 2, and a pencil shaft 4 having a lead end 41 capped by the cap 1 and a push button 42 at the opposite end thereof:

The cap 1 has a blind end 11 at inner portion closing to the cylinder 2, a through-hole 111 at the center portion of the blind hole 11 interconnecting the cylinder 2 and the blind hole 11, two resilient trips 12 extending opposingly from the lower inner wall, and two granular projections 121 being formed on the top portions of the resilient trips 12, respectively. The cylinder 2 has an open gate 21 on one side corresponding to the blade 3 and an open end 22 at the lower end having joining a female step joining face 221 at the inner edge thereof. The blade 3 is secured in the open end 22 of the cylinder 2 slantedly.

Figure 2:
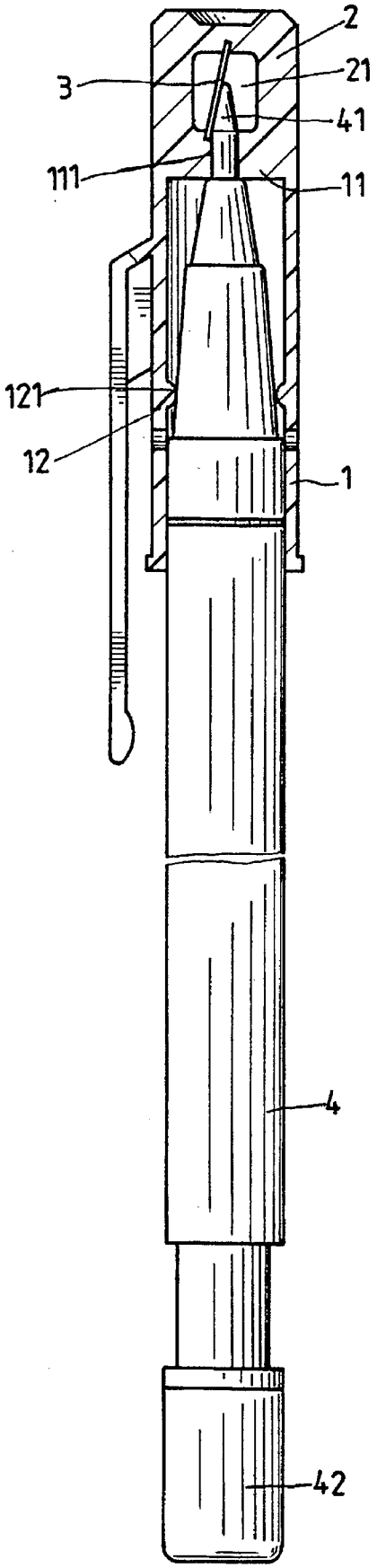
FIG. 2 is a side view showing the lead action of the present invention.

In practicing, referring to FIG. 2, the cap 1 is sleeved on the the pencil shaft 4 with the refill lead 41 passing through the through-hole 111 of the blind end 11 and reaching the cutting edge of the blade 3 in the inner of the cylinder 2. When turning the cap 1 and the pencil shaft 4 towards opposite directions, due to the design of the cap 1, the pencil shaft 4 can be held still during the rotation, which allows the tip of the refill lead 41 to be sharpened, and the lead chip powder is displayed out from the open gate 21, instantly.

Figure 3:
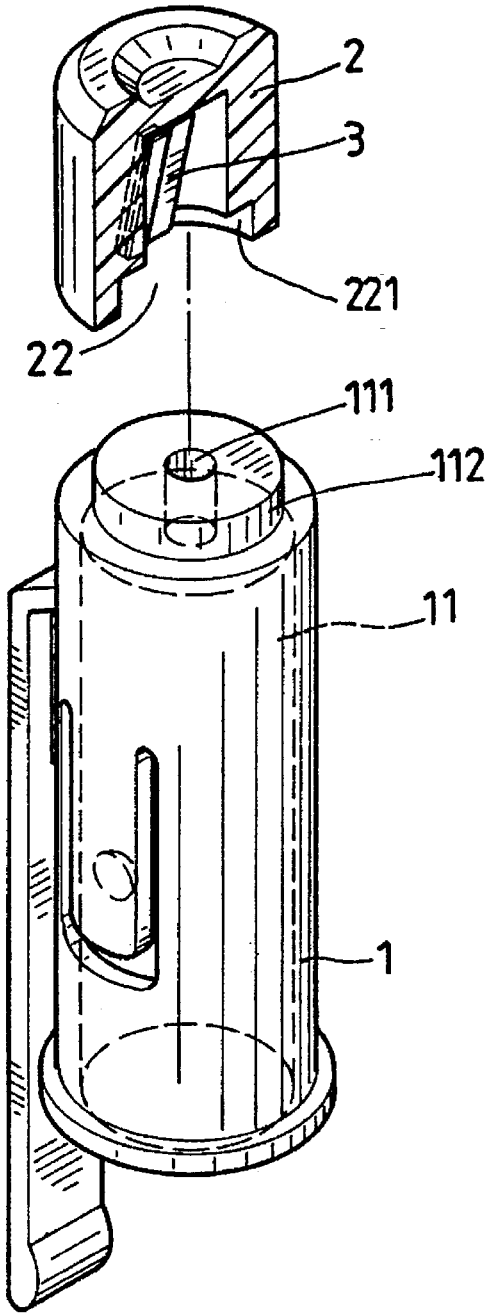
FIG. 3 is an exploded view of a cap of a second embodiment.

Referring to FIG. 3 which illustrates another embodiment of the present invention, in which the cap 1 and the cylinder 2 are separated. The cylinder 2 has secured the blade 3 therein and is connected to the blind end 11 by mean of joining a female step joining face 221 on the open end 22 to a male step joining face 112. The cylinder 2 includes a hollow space which is adapted to collect the lead chip powder.

Figure 4:
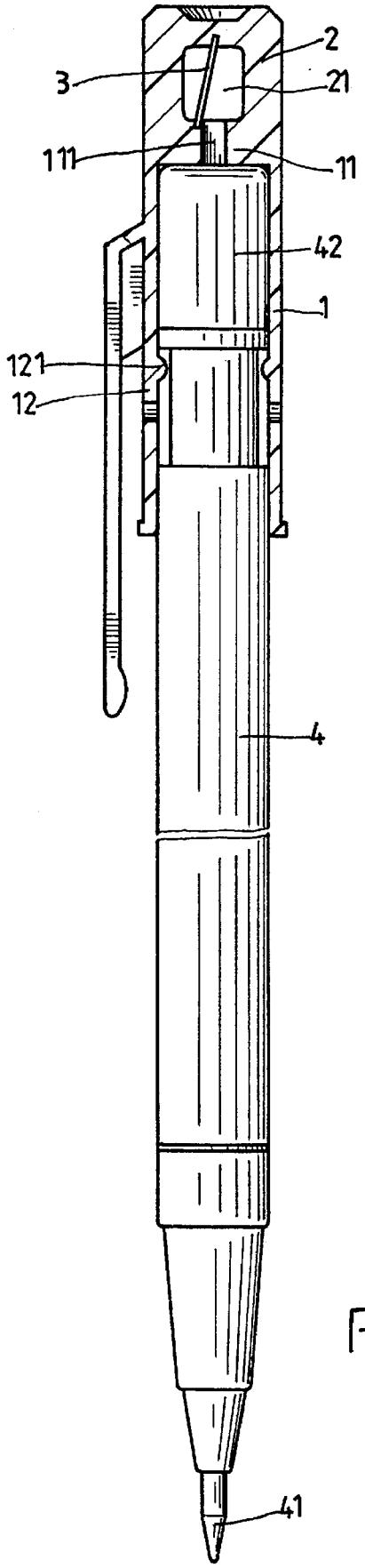
FIG. 4 is a side view showing the cap capped on the rear end of the present invention.

Furthermore, when the sharpener installed in the cap 1 of the present invention is not in use, the cap 1 may be capped on the push button 42 at the other end with the two granular projections 121 extending into the grasping the push button 42, as shown in FIG. 4, which prevents the cap from sliding out, accidentally.

I claim:

1. A cap sharpener for clutch-type pencil being designd to form a lead sharpener with a pencil cap integrally, and the improvements comprising:

said cap having a blind end at top portion and a cylinder on top of said blind end, said blind end having a through-hole corresponding to said cylinder, at least one resilient trip on the inner wall thereof and a granular projection extending inwardly from said resilient trip; said cylinder comprising a blade being held in a slanting angle with respect to the axle of said cap; wherein said through-hole of said blind end permits the lead extending therethrough to reach said blade in said cylinder.

2. A cap sharpener for clutch-type pencil, as recited in claim 1, wherein, said cylinder has an open gate corresponding to said blade for displacing out chip powder.

3. A cap sharpener for clutch-type pencil, as recited in claim 1, wherein, said cylinder is separated from said cap, and holds said blade slantly in a hollow body, and is connected to said blind end by mean of a female and a male joining faces; said hollow space of said cylinder is used to collect the lead chip powder.

* * * * *